US009469935B1

(12) United States Patent
Martin et al.

(10) Patent No.: US 9,469,935 B1
(45) Date of Patent: Oct. 18, 2016

(54) ENHANCING FLAME RETARDANT CHARACTERISTICS OF HIGH-LOFT FABRIC FIRE BARRIERS

(71) Applicant: Precision Custom Coatings LLC, Totowa, NJ (US)

(72) Inventors: Christopher Keith Martin, Wayne, NJ (US); Aneta Konior, Oak Ridge, NJ (US)

(73) Assignee: Precision Custom Coatings, LLC, Totowa, NJ (US)

( * ) Notice: Subject to any disclaimer, the term of this patent is extended or adjusted under 35 U.S.C. 154(b) by 0 days.

(21) Appl. No.: 14/273,123

(22) Filed: May 8, 2014

(51) Int. Cl.
*D06M 11/77* (2006.01)
*A47C 31/00* (2006.01)

(52) U.S. Cl.
CPC ..... *D06M 11/77* (2013.01); *A47C 31/001* (2013.01); *D06M 2200/30* (2013.01)

(58) Field of Classification Search
CPC ..... A47C 31/001; D06M 11/77; D06M 2200/30
See application file for complete search history.

(56) References Cited

U.S. PATENT DOCUMENTS 6,669,882 B2 12/2003 Seok
8,367,203 B2 * 2/2013 Ruf ..... D01F 1/10 106/162.1
2004/0226100 A1 11/2004 Small, Jr. et al.
2012/0258643 A1 * 10/2012 Ruf et al. ..... 5/698

FOREIGN PATENT DOCUMENTS

DE 845230 C 7/1952
GB 338654 A 11/1930

OTHER PUBLICATIONS hittp://coatingsys.com/pdf/What%20are%20the%20applications%20%of%20nano%20clay%20as%20filler%20in%20coatin%E2%80%A6.pdf (undated), viewed Jan. 27, 2016.
U.S. Appl. No. 14/877,611, filed Oct. 7, 2015, entitled "Nanoclay-Modified Fabrics for Flame Retardation" (21 pages).
"What are the applications of nano clay as a filler in coatings?", www.coatingsys.com, 2 pages (undated).

* cited by examiner

*Primary Examiner* — Nicholas Polito
(74) *Attorney, Agent, or Firm* — Greenberg Traurig, LLP

(57) ABSTRACT

A high-loft fabric fire barrier is constructed with a substrate comprised of a blend of non-woven flame retardant cellulosic fibers and thermoplastic polymeric fibers, and a layer of nanoclay material extending along and integrated with at least one of opposite surfaces of the substrate, and preferably along both of the opposite surfaces. The fire barrier is incorporated into the construction of upholstered or cushioned items and, in particular, into a mattress.

10 Claims, 3 Drawing Sheets

ENHANCING FLAME RETARDANT CHARACTERISTICS OF HIGH-LOFT FABRIC FIRE BARRIERS

The present invention relates generally to high-loft fabric fire barriers and pertains, more specifically, to enhancing the flame retardant characteristics of high-loft fabrics constructed to serve as fire barriers in connection with bedding and upholstery and, more particularly, in the manufacture of mattresses.

A greater emphasis on fire safety, particularly in the home, has resulted in an increased demand for fabrics that find use in such domestic items as bedding, upholstery and related items, and which exhibit superior flame retardant characteristics while providing durability, strength and physical qualities commensurate with the furnishings with which these fabrics are employed. In particular, high-loft fabric fire barriers used in connection with the manufacture of mattresses must exhibit requisite strength and durability, without interfering with performance or comfort, while providing a high degree of flame retardant characteristics.

The present invention provides high-loft fabric fire barriers with enhanced flame retardant characteristics through the employment of nanoclay material to thereby fill the need for practical fabric fire barriers that exhibit exemplary performance. As such, the present invention attains several objects and advantages, some of which are summarized as follows: Establishes enhanced flame retardant characteristics in high-loft fabric fire barriers constructed of non-woven inherently flame retardant fibers; provides high-loft fabric fire barriers of exceptional strength, durability and superior flame retardant characteristics; enables the economical manufacture of high-loft fabric fire barriers that exhibit exemplary performance, especially in the construction of mattresses, as well as in domestic bedding and upholstered items; utilizes inherently flame retardant fibers together with nanoclay material for attaining enhanced flame retardant characteristics for exemplary flame retardant performance in the nature of lower thermal transfer and reduced flame propagation, coupled with durability and strength, together with desirable physical characteristics, without the necessity for additional coating operations, or otherwise adding flame retardant chemistry, in order to attain requisite flame retardant properties; simplifies the manufacture of fabric fire barriers exhibiting a high degree of flame retardant performance, utilizing relatively simple, conventional manufacturing techniques; provides highly reliable flame retardant performance in high-loft fabric fire barriers and the like, intended for rugged, long-term service; provides a mattress construction that exhibits enhanced flame retardant characteristics; makes available a wide variety of economical fabric fire barriers for exemplary performance over an extended service life.

The above objects and advantages, as well as further objects and advantages, are attained by the present invention which may be described briefly as a high-loft fabric fire barrier comprising: a substrate comprised of a blend of non-woven flame retardant cellulosic fibers and thermoplastic polymeric fibers, the substrate having opposite surfaces; and a layer of nanoclay material extending along and integrated with at least one of the opposite surfaces of the substrate.

In addition, the present invention provides a method for making a high-loft fabric fire barrier, the method comprising: constructing a substrate of a blend of non-woven flame retardant cellulosic fibers and thermoplastic polymeric fibers, with the substrate having opposite surfaces; and integrating a layer of nanoclay material with the substrate, with the layer of nanoclay material extending along at least one of the opposite surfaces of the substrate.

Further, the present invention includes a mattress constructed with a high-loft fabric fire barrier comprising: a substrate comprised of a blend of non-woven flame retardant cellulosic fibers and thermoplastic polymeric fibers, the substrate having opposite surfaces; and a layer of nanoclay material extending along and integrated with at least one of the opposite surfaces of the substrate.

Still further, the present invention provides a method for making a mattress constructed with a high-loft fabric fire barrier, the method comprising: constructing the fire barrier with a substrate of a blend of non-woven flame retardant cellulosic fibers and thermoplastic polymeric fibers, with the substrate having opposite surfaces; and integrating a layer of nanoclay material with the substrate, with the layer of nanoclay material extending along at least one of the opposite surfaces of the substrate.

The invention will be understood more fully, while still further objects and advantages will become apparent, in the following detailed description of preferred embodiments of the invention illustrated in the accompanying drawing, in which.

Figure 1:
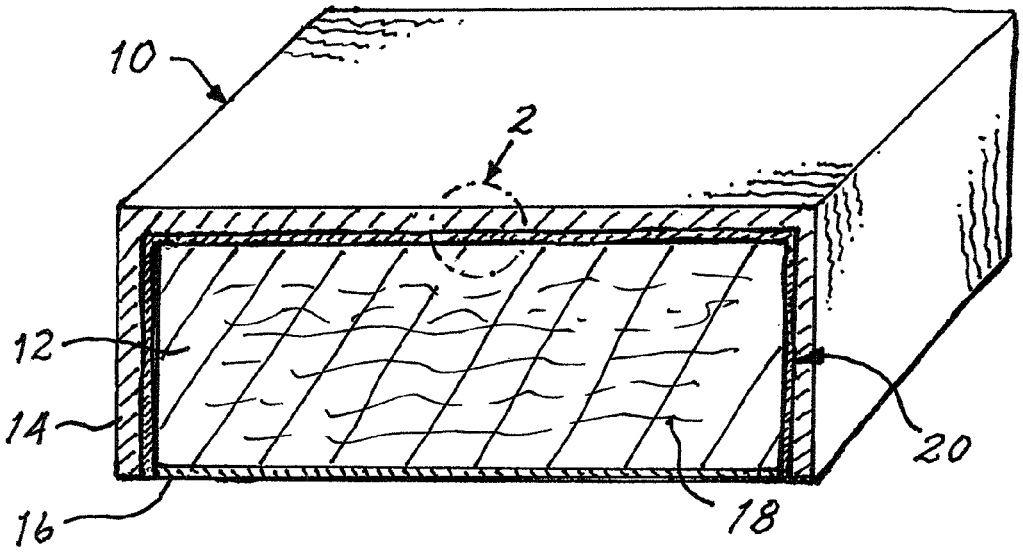
FIG. 1 is a largely diagrammatic depiction of a mattress constructed in accordance with the present invention, sectioned to show internal details of construction.

Referring now to the drawing, and especially to FIG. 1 thereof, a mattress constructed in accordance with the present invention is shown at 10 and is seen to include a core 12 surrounded by ticking 14 and filler cloth 16 in a manner now conventional in the construction of mattresses. Core 12 is comprised largely of combustible materials 18 and, in order to deter combustion of the combustible materials 18 of the core 12, from an external source of combustion, a fabric fire barrier 20, constructed in accordance with the present invention, is interposed between ticking 14 and core 12.

Figure 2:
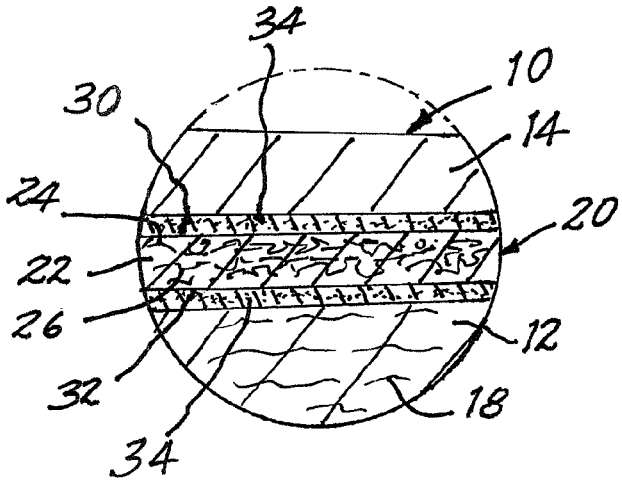
FIG. 2 is an enlarged, fragmentary cross-sectional view of a portion of the mattress designated by the arrow 2 in FIG. 1.

Turning now to FIG. 2, fabric fire barrier 20 includes a substrate 22 of a blend of non-woven inherently flame retardant (FR) cellulosic fibers 24, such as FR viscose fibers or FR rayon fibers, and thermoplastic polymeric fibers 26, such as low-melt polyethylene terephthalate (PET). In the preferred construction, the blend includes about 75% FR cellulosic fibers 24 and about 25% thermoplastic polymeric fibers 26. Substrate 22 is constructed with opposite surfaces 30 and 32, and a layer 34 of nanoclay material extends along each of the surfaces 30 and 32, integrated with substrate 22 in a manner to be described below.

Because these FR cellulosic fibers 24 are selected from inherently flame retardant fibers, further processing for attaining flame retardant properties in these fibers, such as coating or otherwise adding flame retardant chemistry, is unnecessary. However, in order to enhance the FR characteristics of fire barrier 20, while simplifying manufacture, layer 34 of nanoclay material is integrated with at least one of the surfaces 30 and 32 of substrate 22, and preferably with both surfaces 30 and 32 of substrate 22, as seen in FIG. 2. Such inherently flame retardant fibers and nanoclay materials are available commercially, and can be made ready for use as described, rendering manufacture of fire barrier 20 with enhanced FR characteristics economical as well as simple. In the most-preferred embodiment, fire barrier 20 is constructed in a total weight within the range of about two to about eight ounces per square yard, with the nanoclay material included in an amount of about 0.005% to about 10% of the total weight. The preferred nanoclay material is available commercially under the trademark CLOISITE® Na+.

The fire barrier 20 exhibits lower thermal transfer and reduced flame propagation as compared to conventional fabric fire barriers. The superior qualities of fire barrier 20 render fire barrier 20 especially well suited to incorporation into the manufacture of mattresses, as well as into many upholstered or cushioned applications.

Figure 3:
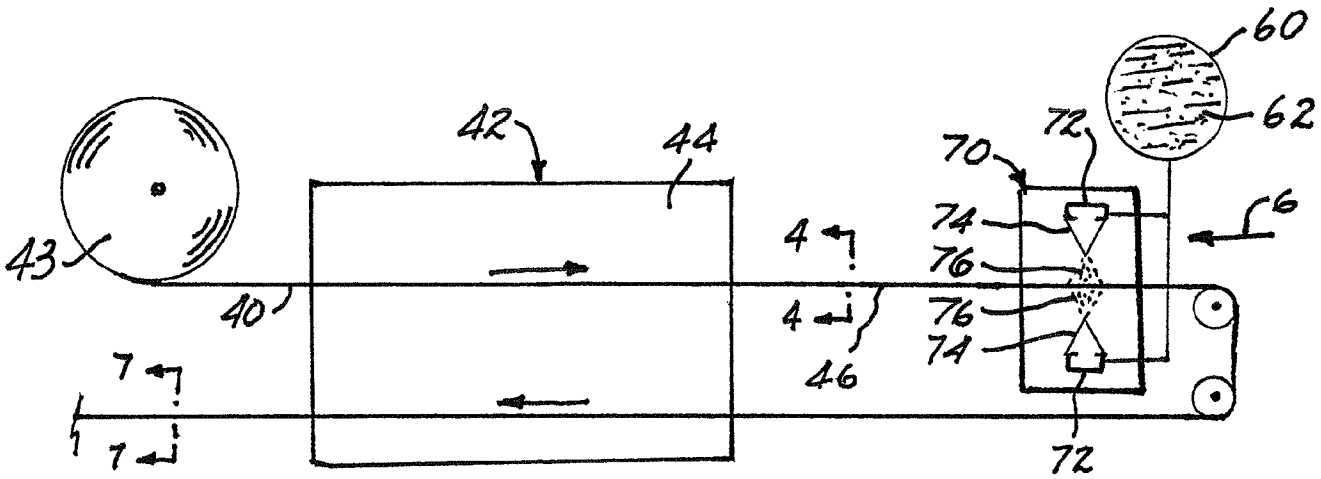
FIG. 3 is a diagrammatic depiction of an apparatus conducting a method of manufacture of a high-loft fabric fire barrier constructed in accordance with the present invention.
Figure 5:
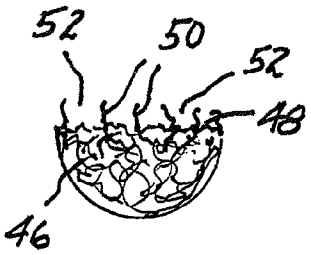
FIG. 5 is a further enlarged fragmentary cross-sectional view of a portion of FIG. 4, designated by arrow 5 in FIG. 4.
Figure 4:
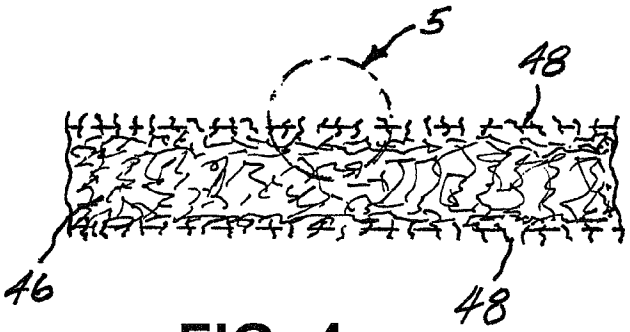
FIG. 4 is an enlarged, fragmentary cross-sectional view taken along line 4-4 of FIG. 3.

Referring now to FIGS. 3 through 7, manufacture of fire barrier 20 in accordance with the present invention is depicted diagrammatically in FIG. 3 wherein it is seen that a blend of non-woven inherently flame retardant cellulosic fibers and thermoplastic polymeric fibers in the form of a continuous batt 40 is advanced through an apparatus 42, from a supply roll 43, into an oven 44 where the blend of fibers within batt 40 is bound into a high-loft fabric that emerges from the oven 44 in the form of a sheet 46 that includes opposite filamentous surfaces 48. As best seen in FIGS. 4 and 5, the filamentous nature of surfaces 48 is a result of fibers of the batt 40 projecting from the batt 40 in the form of a multitude of filaments 50, with interstices 52 between the filaments 50.

Figure 6:
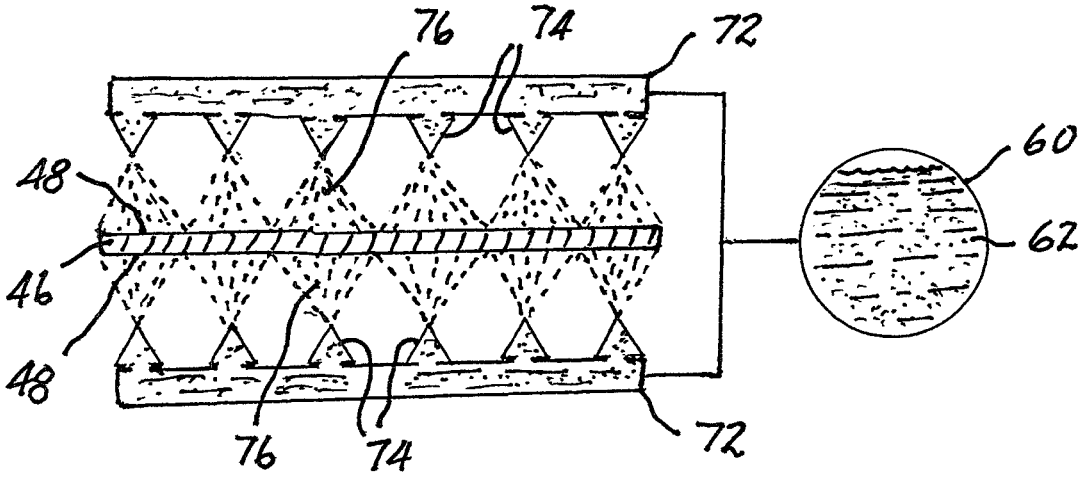
FIG. 6 is a diagrammatic, fragmentary view taken in the direction of arrow 6 in FIG. 3.

Apparatus 42 includes a supply 60 of a dispersion 62 of finely divided nanoclay material dispersed within a liquid carrier, the preferred liquid being water. The sheet 46 is passed to a station 70 where dispersion 62 is applied to each surface 48 of sheet 46, preferably through respective banks 72 of spray heads 74 which direct a fine mist spray 76 to each corresponding surface 48, as seen in FIG. 6. The fine mist spray 76 assures that the dispersion 62 enters the interstices 52 between the filaments 50 of sheet 46.

Figure 7:
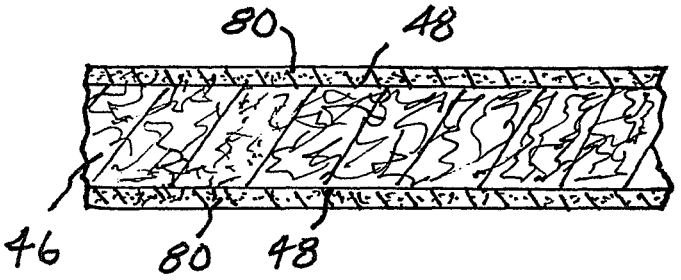
FIG. 7 is an enlarged, fragmentary cross-sectional view taken along line 7-7 of FIG. 3.

Upon leaving station 70, sheet 46 is directed back into oven 44 where the liquid carrier of the dispersion 62 within the interstices 52 is driven off, leaving nanoclay material deposited within the interstices 52 to be integrated with the sheet 46, in a layer 80 of nanoclay material extending along each surface 48 of the sheet 46, as seen in FIG. 7. The sheet 46 then is ready for dividing into appropriately dimensioned fire barriers 20 in which a layer 34 of nanoclay material extends along each of the surfaces 30 and 32 of substrate 22, integrated with substrate 22, as illustrated in FIG. 2.

The layers 34 of nanoclay material provide fire barrier 20 with lowered thermal transmission properties as compared to previous fabric fire barriers. In addition, by virtue of filling the interstices 52 with nanoclay material, the filamentous nature of the surfaces 48 is substantially reduced, and preferably eliminated, producing a concomitant reduction in flame propagation across the completed fire barrier 20.

It will be seen that the present invention attains all of the objects and advantages summarized above, namely: Establishes enhanced flame retardant characteristics in high-loft fabric fire barriers constructed of non-woven inherently flame retardant fibers; provides high-loft fabric fire barriers of exceptional strength, durability and superior flame retardant characteristics; enables the economical manufacture of high-loft fabric fire barriers that exhibit exemplary performance, especially in the construction of mattresses, as well as in domestic bedding and upholstered items; utilizes inherently flame retardant fibers together with nanoclay material for attaining enhanced flame retardant characteristics for exemplary flame retardant performance in the nature of lower thermal transfer and reduced flame propagation, coupled with durability and strength, together with desirable physical characteristics, without the necessity for additional coating operations, or otherwise adding flame retardant chemistry, in order to attain requisite flame retardant properties; simplifies the manufacture of fabric fire barriers exhibiting a high degree of flame retardant performance, utilizing relatively simple, conventional manufacturing techniques; provides highly reliable flame retardant performance in high-loft fabric fire barriers and the like, intended for rugged, long-term service; provides a mattress construction that exhibits enhanced flame retardant characteristics; makes available a wide variety of economical fabric fire barriers for exemplary performance over an extended service life.

It is to be understood that the above detailed description of preferred embodiments of the invention is provided by way of example only. Various details of composition, construction and procedure may be modified without departing from the true spirit and scope of the present invention, as set forth in the appended claims.

The embodiments of the invention in which an exclusive property or privilege is claimed are defined as follows:

1. A method for making a high-loft fabric fire barrier, the method comprising the steps of:

constructing a substrate of a blend of non-woven inherently flame retardant cellulosic fibers and thermoplastic polymeric fibers, with the substrate having first and second filamentous surfaces opposite each other, each of the first and second filamentous surfaces having one or both of a respective plurality of the cellulosic fibers and a respective plurality of the thermoplastic polymeric fibers projecting therefrom, and further having interstices among the projecting fibers of the first and second surfaces;

providing a dispersion of a nanoclay material in a liquid carrier;

applying the dispersion to the first filamentous surface of the substrate so that some of the dispersion enters the interstices thereof; and driving off the liquid carrier from the substrate so that the nanoclay material extends as a first layer of nanoclay material along the first filamentous surface of the substrate and into the interstices thereof, whereby the first layer of the nanoclay material is integrated with the substrate.

2. The method of claim 1 wherein:

the fire barrier has a total weight in the range of about two to about eight ounces per yard; and the nanoclay material is present in the fire barrier in an amount in the range of about 0.005% to about 10% of the total weight of the fire barrier.

3. The method of claim 1, wherein the step of driving off the liquid carrier from the substrate is further performed so that the nanoclay material extends as a second layer of nanoclay material along the second filamentous surface of the substrate and into the interstices thereof, whereby the second layer of the nanoclay material is integrated with the substrate.

4. The method of claim 3 wherein the fire barrier has a total weight in the range of about two to about eight ounces per yard, and the nanoclay material is present in the fire barrier in an amount in the range of about 0.005% to about 10% of the total weight of the fire barrier.

5. The method of claim 1 wherein the applying step fills at least some of the interstices of the first filamentous surface with the nanoclay material.

6. A method for making a mattress constructed with a high-loft fabric fire barrier, the method comprising the steps of:

constructing the fire barrier with a substrate of a blend of non-woven inherently flame retardant cellulosic fibers and thermoplastic polymeric fibers, the substrate having first and second filamentous surfaces opposite each other, each of the first and second filamentous surfaces having one or both of a respective plurality of the cellulosic fibers and a respective plurality of the thermoplastic polymeric fibers projecting therefrom, and further having interstices among the projecting fibers of the first and second filamentous surfaces;

providing a dispersion of a nanoclay material in a liquid carrier;

applying the dispersion to the first filamentous surface of the substrate so that some of the dispersion enters the interstices thereof; and driving off the liquid carrier from the substrate so that the nanoclay material extends as a first layer of nanoclay material along the first filamentous surface of the substrate and into the interstices, whereby the first layer of the nanoclay material is integrated with the substrate.

7. The method of claim 6 wherein:

the fire barrier has a total weight in the range of about two to about eight ounces per yard; and the nanoclay material is integrated with the substrate in an amount in the range of about 0.005% to about 10% of the total weight of the fire barrier.

8. The method of claim 6, wherein the step of driving off the liquid carrier from the substrate is further performed so that the nanoclay material extends as a second layer of nanoclay material along the second filamentous surface of the substrate and into the interstices thereof, whereby the second layer of the nanoclay material is integrated with the substrate.

9. The method of claim 8, wherein the fiber barrier has a total weight in the range of about two to about eight ounces per yard, and the nanoclay material is present in the fire barrier in an amount in the range of about 0.005% to about 10% of the total weight of the fire barrier.

10. The method of claim 6, wherein the applying step fills at least some of the interstices of the first filamentous surface with the nanoclay material.

* * * * *